US008590107B2

(12) United States Patent
Omann

(10) Patent No.: US 8,590,107 B2
(45) Date of Patent: Nov. 26, 2013

(54) RETAINING CLIP FOR AN ACTUATOR OF A FURNITURE FLAP

(75) Inventor: Christian Omann, Hard (AT)

(73) Assignee: Julius Blum GmbH, Hochst (AT)

( * ) Notice: Subject to any disclaimer, the term of this patent is extended or adjusted under 35 U.S.C. 154(b) by 109 days.

(21) Appl. No.: 13/091,449

(22) Filed: Apr. 21, 2011

(65) Prior Publication Data

US 2011/0193458 A1 Aug. 11, 2011

Related U.S. Application Data

(63) Continuation of application No. PCT/AT2009/000349, filed on Sep. 7, 2009.

(30) Foreign Application Priority Data

Nov. 6, 2008 (AT) ..... A 1726/2008

(51) Int. Cl.
*E05F 5/00* (2006.01)
*E05F 1/10* (2006.01)

(52) U.S. Cl.
USPC ..... 16/319; 188/82.77; 188/184; 192/215

(58) Field of Classification Search
USPC ..... 49/322; 188/82.77, 184, 189
See application file for complete search history.

(56) References Cited

U.S. PATENT DOCUMENTS

| | | | | |
|---|---|---|---|---|
| 1,353,219 | A * | 9/1920 | Collins | 16/64 |
| 3,421,605 | A * | 1/1969 | Hansen | 188/82.77 |
| 6,473,936 | B2 * | 11/2002 | Orita | 16/82 |
| 7,562,757 | B2 * | 7/2009 | Dubach et al. | 192/215 |

FOREIGN PATENT DOCUMENTS

| | | |
|---|---|---|
| EP | 0 298 514 | 1/1989 |
| EP | 1 055 381 | 11/2000 |
| EP | 1 217 159 | 6/2002 |
| JP | 2003-227268 | 8/2003 |
| WO | 2006/069412 | 7/2006 |

OTHER PUBLICATIONS

Machine translation of JP 2003-227268 A, Feb. 7, 2013.*
International Search Report issued Nov. 24, 2009 in International (PCT) Application No. PCT/AT2009/000349.
Austrian Patent Office Search Report issued Aug. 3, 2009 in Austrian Patent Application No. A 1726/2008.

* cited by examiner

*Primary Examiner* — Rodney Bonck
(74) *Attorney, Agent, or Firm* — Wenderoth, Lind & Ponack, L.L.P.

(57) ABSTRACT

The invention relates to an actuator, including at least one pivotably supported actuating arm for moving a furniture flap. The actuating arm is or can be acted on by a spring device, and a retaining clip is proposed for the empty actuating arm on which no furniture flap is mounted yet. The retaining clip prevents accidental opening or deflecting of the empty actuating arm and for this purpose includes a brake or detent device which can be moved by a shaft (R). A transmission gear is provided by which the pivot speed of the actuating arm can be geared to a higher rotational speed of the shaft (R) at least over a region of the pivot travel of the actuating arm in the open direction.

19 Claims, 6 Drawing Sheets

RETAINING CLIP FOR AN ACTUATOR OF A FURNITURE FLAP

This application is a continuation application of International application No. PCT/AT2009/000349, filed Sep. 7, 2009, the entire disclosure of which is incorporated herein by reference.

BACKGROUND OF THE INVENTION

The present invention relates to an actuating device comprising at least one pivotably mounted actuating arm for moving a furniture flap. The actuating arm is or can be acted upon by a spring device, and there is provided an assembly securing device for the vacant actuating arm on which therefore no furniture flap has yet been fitted. The assembly securing device prevents accidental opening or deflection of the vacant actuating arm and for that purpose has a braking or latching device which can be moved by way of a shaft.

The invention further concerns an article of furniture having an actuating device of the kind to be described.

Such actuating devices serve for example to move a furniture flap which is connected to the pivotally mounted actuating arm between a vertical position in which a compartment in a carcass is covered and an upwardly moved open position. To compensate for the weight of the flap there is provided a spring device or a gas pressure storage means, and the torque acting on the actuating arm can be adjusted selectively to the weight of the flap to be moved. In the case of heavy furniture flaps, therefore, a very high torque is to be provided as the biasing force for the actuating arm. If now the actuating device is already pre-assembled to the article of furniture in the course of assembly, there is as yet no furniture flap pivotally connected to the actuating arm. Thus, there is a serious risk that the actuating arm can be massively deflected by the spring device acting thereon and as a result can seriously injure the assembly personnel. Therefore, WO 2006/069412 A1 to the present applicant already discloses an assembly securing device for the "vacant" actuating arm—to which therefore no furniture flap has yet been fitted—, which has a braking or latching device for limiting the opening speed of the vacant actuating arm.

SUMMARY OF THE INVENTION

It is an object of the present invention to propose an actuating device with an assembly securing device of the general kind set forth in the opening part of this specification, which prevents uncontrolled opening or deflection of the actuating arm even when very high biasing forces of the spring device are applied thereon.

In accordance with the invention in an advantageous configuration, the object is achieved in that there is provided a step-up transmission by which the pivotal speed of the actuating arm—at least over a region of the pivot travel of the actuating arm in the opening direction—can be stepped up to a higher rotary speed of the shaft.

It is to be noted that the spring device acts on the actuating arm in the opening direction about an axis of rotation so that, when the flap is pivotably connected, a sufficiently high level of torque is provided for compensating for the weight of the flap. The higher the force of the spring device acting on the actuating arm, the correspondingly greater is the risk that the actuating arm deflects over a tolerable pivotal range when the flap is not pivotably connected thereto—even if there is provided a braking or latching device for preventing the actuating arm from kicking out. The arrangement of the step-up transmission can therefore reduce the reaction time of the braking or latching device as, upon an increase in the spring force (for example when fitting a spring device with increased standardized spring force), faster braking or stopping of the actuating arm also occurs.

The invention can be particularly advantageously implemented with braking or latching devices which comprise a centrifugal clutch for braking or stopping the actuating arm. More specifically, the step-up transmission provides that a slight pivotal movement of the spring-loaded actuating arm already triggers a rotary movement of the shaft, which is increased by a defined ratio. Accordingly, when a predetermined pivotal speed of the actuating arm is exceeded, the braking or latching device also reacts substantially more quickly than in the case of conventional devices.

A further advantageous effect in terms of the arrangement of the step-up transmission is that the braking or latching device does not have to directly compensate for the enormous torque of the actuating arm. The step-up transmission provides that the holding moment occurring in the braking or latching device is also markedly reduced so that the unit formed by the braking or latching device can be smaller and possibly also less expensive. A braking or latching device of relatively small geometrical dimensions is of particular advantage by virtue of the very limited structural space in actuating devices.

An embodiment of the invention provides that the transmission ratio (i) of the step-up transmission is greater than 3, preferably greater than 5. That means for example that, in the case of a transmission ratio equal to 5, a pivotal movement of the actuating arm through 10° results in a rotary movement of the shaft (which is associated with the braking or latching device) through 50°. The desired higher transmission ratio is therefore determined by the ratio between the rotary speed of the shaft and the pivotal speed of the actuating arm.

Various options present themselves to the person skilled in the art for implementing the step-up transmission. In an embodiment, it can be provided that the step-up transmission has a pinion gear transmission. In that respect, a so-called internal gear pair has proven to be particularly advantageous, in which a pinion mounted to the shaft meshes with an internal tooth arrangement of a hollow gear or a tooth portion. The transmission ratio can be determined by the ratio of the diameter of the pinion to the diameter of the internal tooth arrangement. In that respect the length of the tooth portion can correspond approximately to the length of the pivotal range of the actuating arm.

Alternatively thereto, however, other design configurations are also possible for the gear transmission. Basically it is sufficient if the gear transmission has a first pinion meshing with at least one second pinion or a tooth arrangement of different size. In that connection it may be desirable if the first pinion is associated with the shaft and the second pinion or the tooth arrangement is associated with the housing of the actuating device. In that respect, it can be provided that, during the pivotal movement of the actuating arm, the first pinion runs along a tooth arrangement which is preferably stationarily arranged on the housing of the actuating device. The step-up transmission can also embrace structures with a toothed belt or the like.

The centrifugal clutch provided for braking or stopping the actuating arm can have at least one movably mounted first clutch portion which is movable starting from a rest position (also against the force of a spring) into an outer position in which the first clutch portion can come into contact with a second clutch portion and can preferably be latched thereto. In that respect, it is provided that under a predetermined pivotal speed of the actuating arm, the first clutch portion and the second clutch portion are uncoupled from each other and when a predetermined pivotal speed of the actuating arm is exceeded, the first clutch portion and the second clutch portion can come into contact with each other.

An embodiment of the invention provides at least two first clutch portions which can come into contact with a second clutch portion after the mass moment of inertia has been overcome (and possibly after a spring force has been overcome). The first clutch portions can have latching teeth (or latching recesses) or alternatively can also be provided with a friction lining. However, in the sense of immediately stopping the actuating arm, it may be desirable if the first clutch portion has at least one latching tooth which is latchable with at least one latching recess arranged or formed on the second clutch portion. It may also be advantageous if the first clutch portion or portions has or have a plurality of latching teeth and the second clutch portion has a plurality of latching recesses.

An embodiment of the invention provides that the braking or latching device is arranged in or on a portion fixedly connected to the actuating arm and is also moved therewith. In that respect, it may be desirable for the braking or latching device to be arranged on a rotatable control cam associated with the actuating arm.

The article of furniture according to the invention is characterized by at least one actuating drive of the described kind.

BRIEF DESCRIPTION OF THE DRAWINGS

Further details and advantages of the invention will be apparent from the specific description hereinafter. In the drawings.

DETAILED DESCRIPTION OF THE INVENTION

Figure 1:
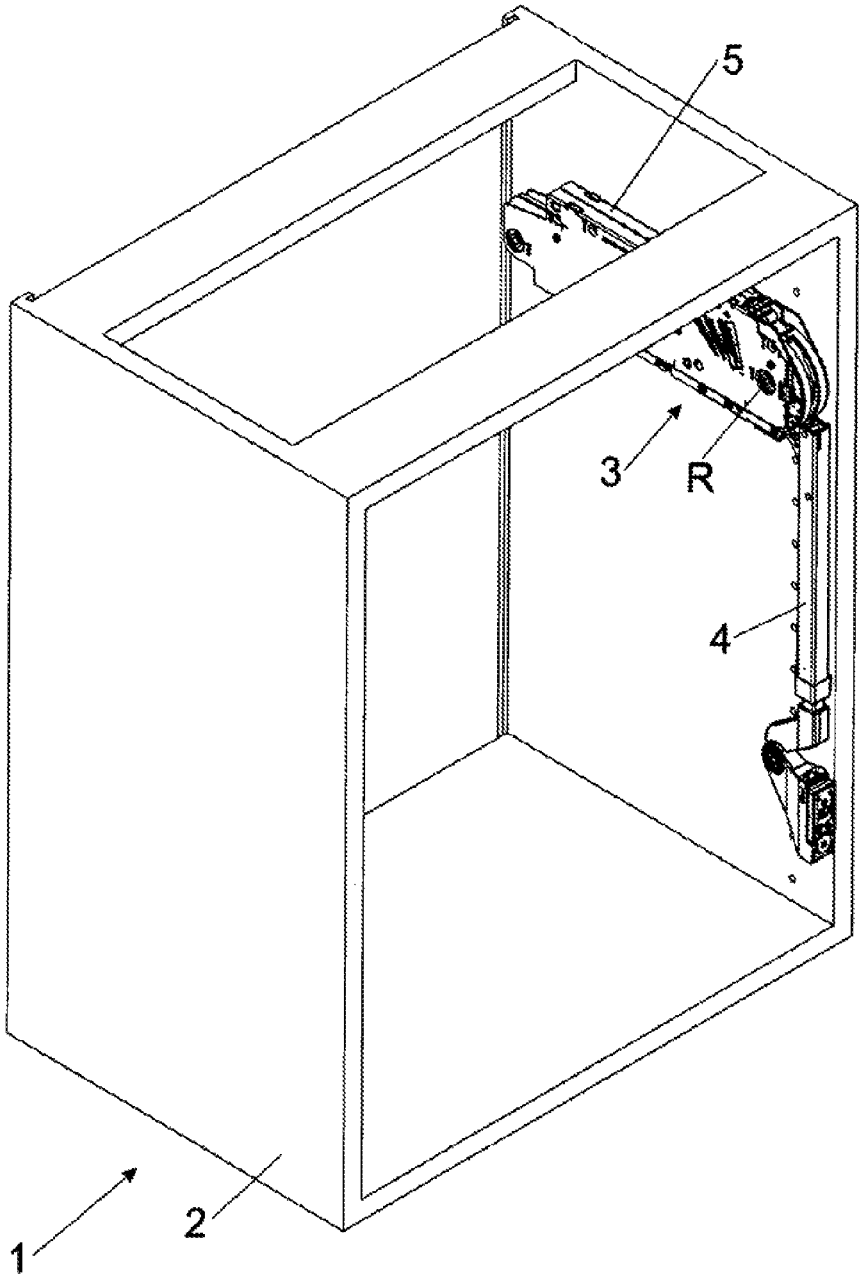
FIG. 1 shows a perspective view of an article of furniture in cabinet form with an actuating device, whereby the actuating arm thereof has not yet been fitted with a furniture flap.

FIG. 1 shows a perspective view of an article of furniture 1 in cabinet form in a typical assembly situation. An actuating device 3 according to the invention has been pre-assembled to the furniture carcass 2, the actuating device 3 has at least one actuating arm 4 for moving an upwardly movable furniture flap (not shown). The actuating arm 4 is mounted pivotably about an axis of rotation (R) between a closed position—as shown in the Figure—and an open position. The actuating arm 4 is or can be acted upon by a spring device arranged in the housing 5, the spring device urging the actuating arm 4 about the axis of rotation R in the direction of the open position. The spring device therefore serves for compensating for the weight of the flap, in which case the actuating arm 4 is biased with extremely high forces—depending on the respective weight of the flap which is still to be connected thereto. In the illustrated assembly situation in which therefore a flap has not yet been fitted, the actuating arm 4 can move uncontrolledly rapidly in the direction of the open position and in so doing cause serious injury.

Figure 2:
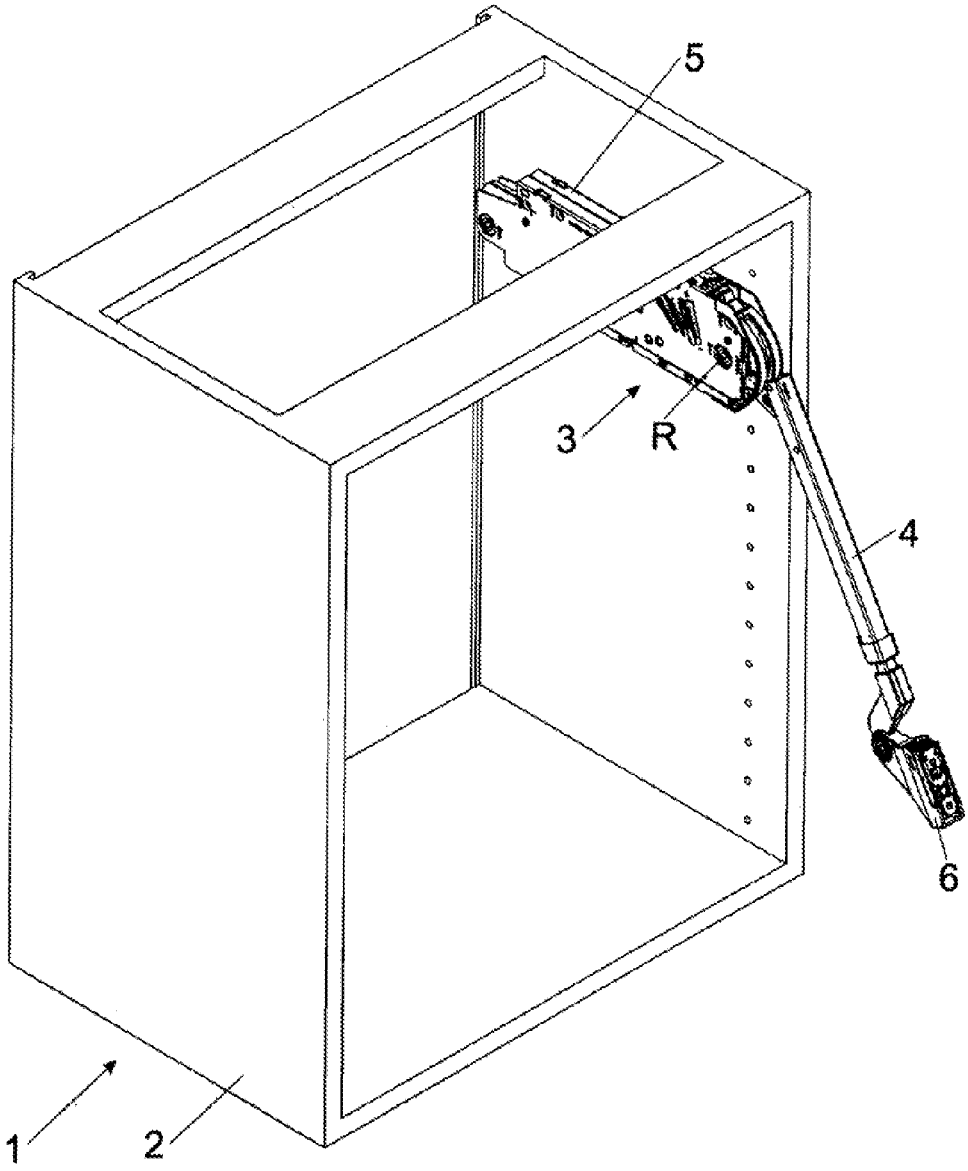
FIG. 2 shows the article of furniture of FIG. 1 with the actuating device whose actuating arm is arrested in an open position.

FIG. 2 shows the arrangement of FIG. 1, wherein, after exceeding an admissible pivotal speed in the opening direction, the "vacant" actuating arm 4 is immediately arrested in its instantaneous pivotal position. The actuating arm 4 is adapted to be variable in length and has a connecting portion 6 latchable to a fitment portion associated with the furniture flap.

Figure 3A:
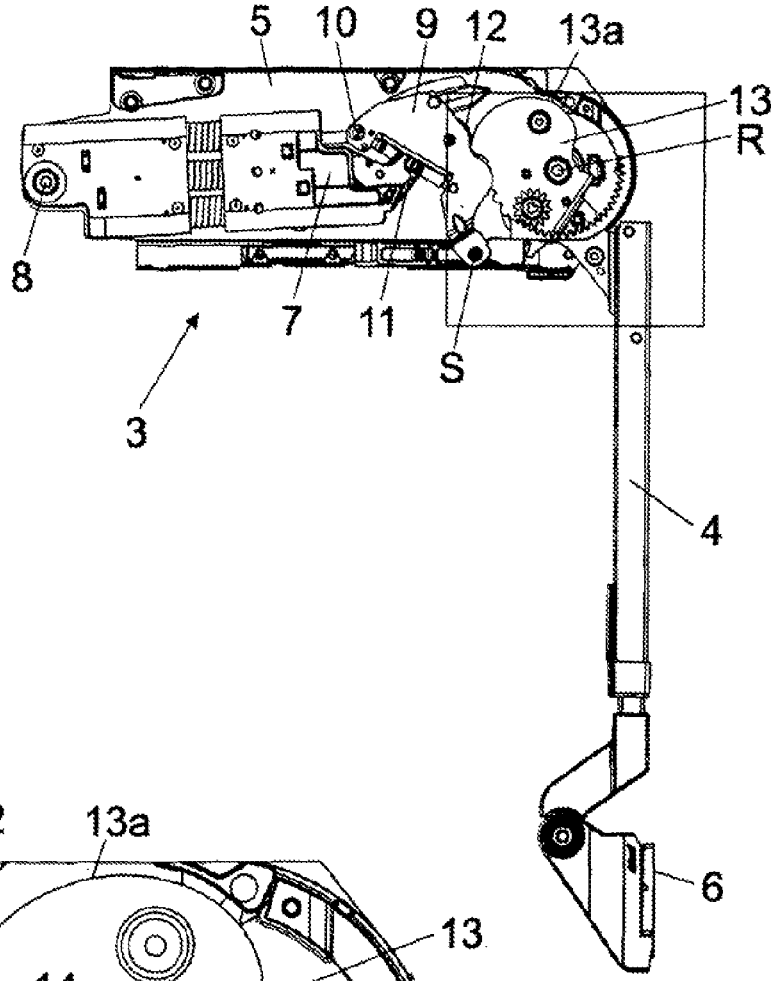
FIGS. 3*a*, 3*b* show a side view of an actuating device according to the invention in the unlatched condition and a detail view on an enlarged scale thereof.

FIG. 3*a* shows a side view of the actuating device. It is possible to see a spring device 7 in the form of a spring pack which is supported on the one hand against a portion 8, which is fixed with respect to the article of furniture, on the housing 5, and which on the other hand acts on an intermediate lever 9 pivotal about axis of rotation S. An adjusting device 10 is provided to adjust the spring force acting on the actuating arm 4, whereby the position of the spring mounting 11 is variably adjustable relative to the axis of rotation S. Supported on the intermediate lever 9 is a pressure roller 12 which can run along a control contour 13*a* associated with the actuating arm 4 during the pivotal movement of the actuating arm 4 under the pressure of the spring device 7. The control contour 13*a* is formed by the peripheral edge of a control cam 13 rotatable about the axis of rotation (R), wherein the control cam 13 is or can be fixedly connected to the actuating arm 4.

Figure 3B:
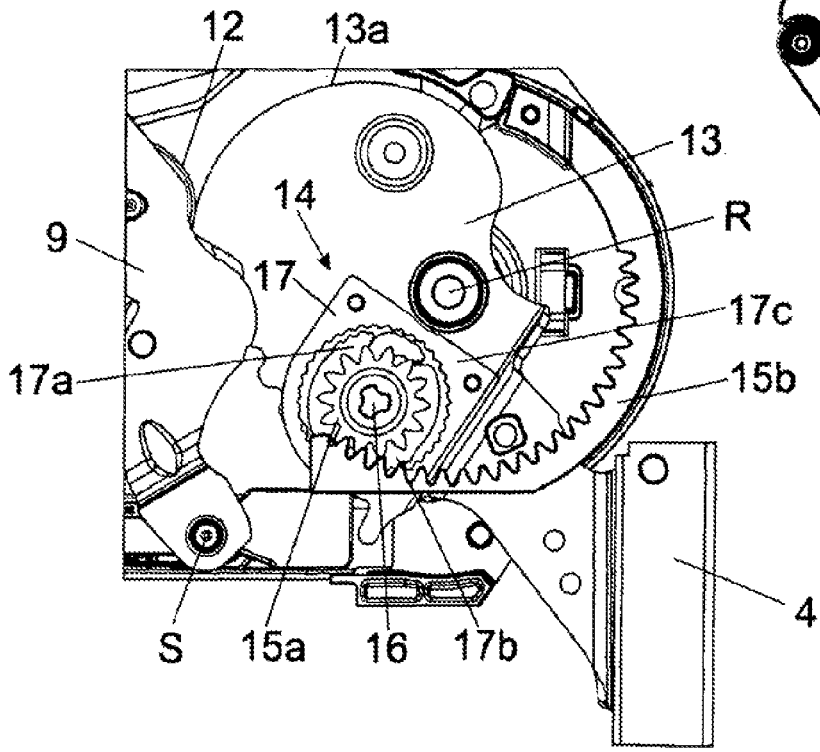

FIG. 3*b* shows an enlarged view of the region identified in FIG. 3*a*. It shows the control cam 13 which is fixedly connected to the actuating arm 4 and which is pivotable about the axis of rotation R of the arm 4. An aspect of substantial significance is a braking or latching device 14 which is arranged at the rotatable control cam 13 and which, during the pivotal movement of the control cam 13, is also moved therewith. The braking or latching device 14 includes a gear transmission comprising a first pinion 15*a* arranged rotatably on a shaft 16, the shaft 16 being mounted rotatably at the control cam 13. During the pivotal movement of the actuating arm 4, the first pinion 15*a* runs along an arc-shaped tooth arrangement (rack) 15*b* arranged stationarily on the housing 5 of the actuating device 3. It will be seen that the tooth arrangement (rack) 15*b* has a larger diameter than the diameter of the first pinion 15*a*, thereby affording the increased step-up ratio. More specifically, if the radius of the tooth arrangement 15*b* is selected to be greater by the factor of 5 than the radius of the first pinion 15*a*, a pivotal movement of the actuating arm 4 through 10° leads to a rotary movement of the first pinion 15*a*, which is five times greater, whereby therefore the first pinion 15*a* is rotated through 50°. The braking or latching device 14 includes a centrifugal clutch 17 comprising two first clutch portions 17*a* and 17*b* which, when the actuating arm 4 exceeds a predetermined pivotal speed, are moved from an inner rest position in a radial direction into an outer position so that the two first clutch portions 17*a* and 17*b* latch with a second clutch portion 17*c* having an internal tooth arrangement. The two first clutch portions 17*a* and 17*b* are arranged behind the first pinion 15*a* and are mounted movably relative to the rotatable shaft 16. The first pinion 15*a*, with the tooth arrangement 15*b*, forms a so-called internal gear pair by way of the pivotal travel of the actuating arm 4, wherein the step-up transmission ratio can be defined by way of the radius of the first pinion 15*a* and the radius of the tooth arrangement 15*b*.

Figure 4A:
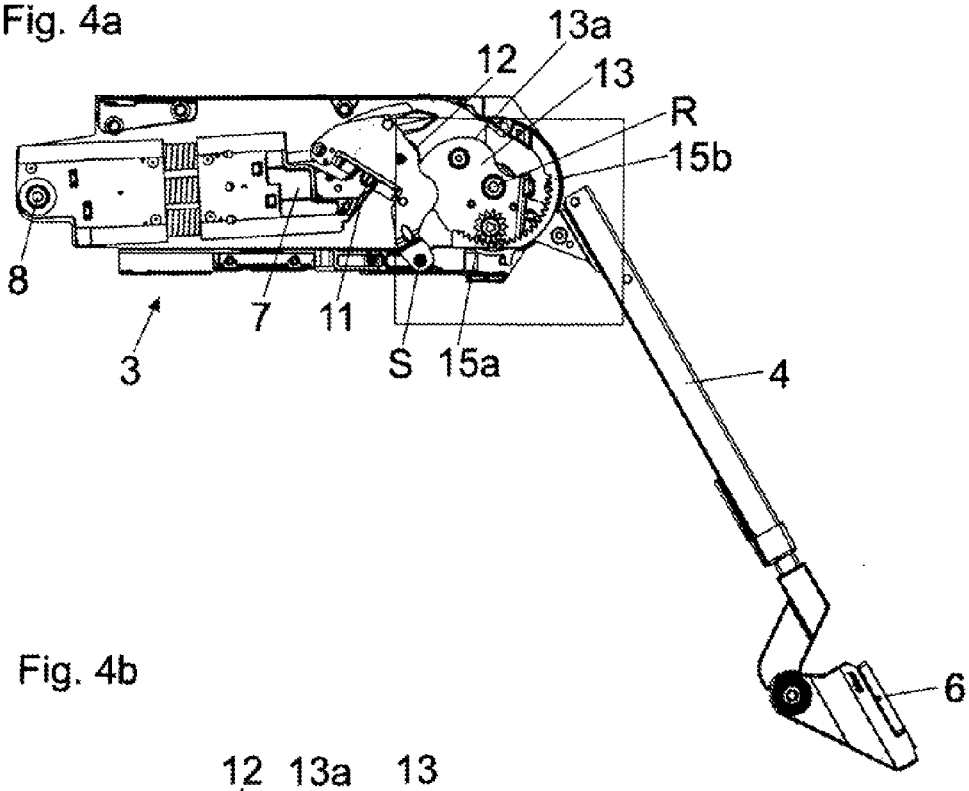
FIGS. 4*a*, 4*b* show a side view of an actuating device according to the invention in the latched condition and a detail view on an enlarged scale thereof.
Figure 4B:
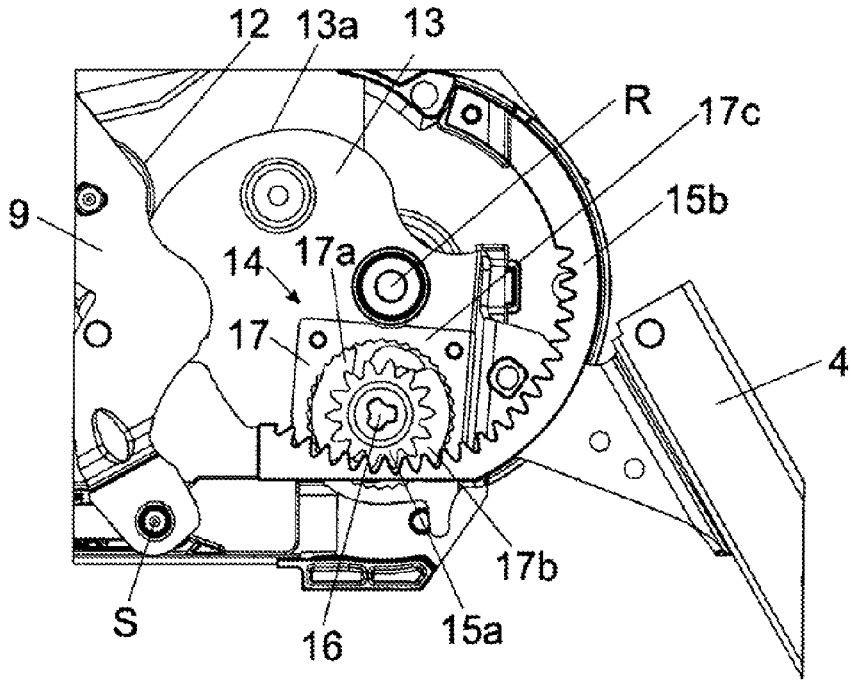

FIG. 4*a* and FIG. 4*b* show similar views to FIG. 3*a* and FIG. 3*b* with an actuating arm 4 which is further pivoted in the direction of the open position and which is arrested in its pivotal position by the braking or latching device 14. FIG. 4*b* shows an enlarged view of the region identified in FIG. 4*a*. The actuating arm 4 with its control cam 13 has been pivoted about the axis of rotation (R) from the closed position shown in FIG. 3*b* in the direction of the open position, in which case the control contour 13*a* of the control cam 13 runs on the pressure roller 12. In that pivotal movement of the actuating arm 4, the first pinion 15*a* can also run against the tooth arrangement (rack) 15*b* arranged stationarily on the housing 5, whereby the shaft 16 is also rotated by a defined multiple relative to the pivotal speed of the actuating arm 4. Below a predetermined pivotal speed of the actuating arm 4, the shaft 16 is moved, without the two first clutch portions 17*a*, 17*b* of the centrifugal clutch 17 latching with the tooth arrangement of the outer second clutch portion 17*c*, whereby the actuating arm 4 can also be moved unimpededly between the closed position and the open position. That is the case when a furniture flap is properly pivotably connected to the actuating arm 4 as the weight of the flap acts in opposition to the force of the spring device 7. If, however, no furniture flap is pivotally connected to the actuating arm 4 then, when an admissible pivotal speed is exceeded, the actuating arm 4 is immediately arrested in its instantaneous pivotal position by the braking or latching device 14 as both first clutch portions 17*a* and 17*b* are moved radially outwardly by the acting centrifugal force and are latched to the inner tooth arrangement of the outer second clutch portion 17*c*. The latching action can be released again by manually applying pressure to the actuating arm 4 in the direction of the closed position.

Figure 5A:
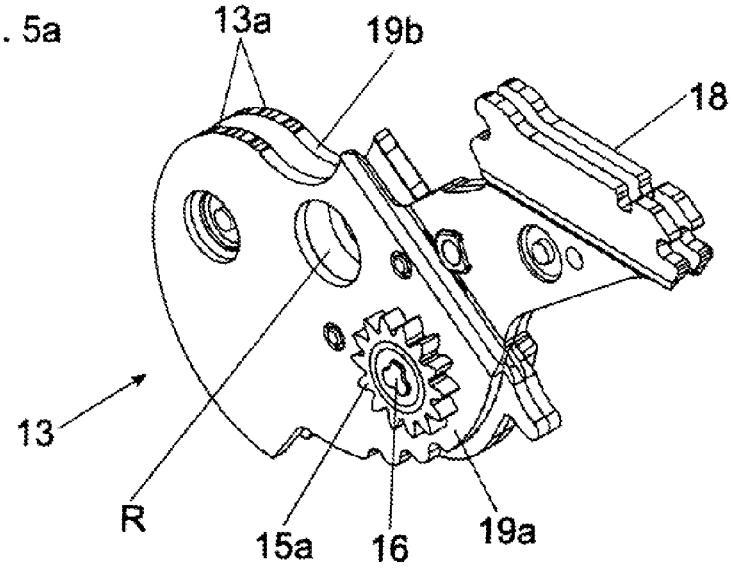
FIGS. 5*a*, 5*b* show the braking or latching device arranged on the control cam of the actuating arm and an exploded view thereof.
Figure 5B:
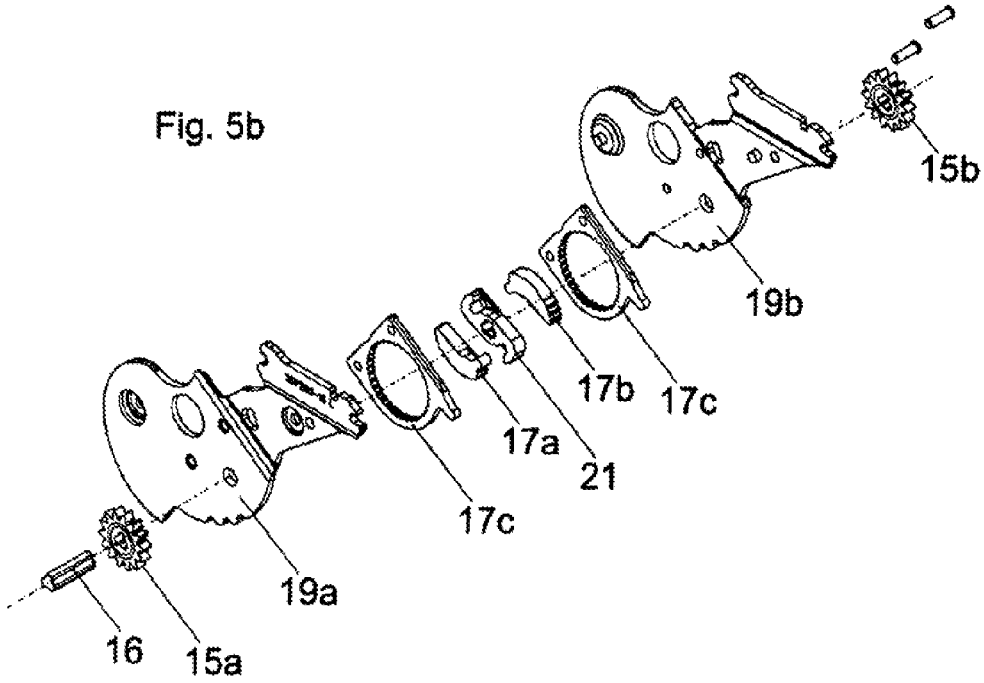

FIG. 5*a* shows the control cam 13 which is pivotally arranged about the axis of rotation R and which is latchable to the actuating arm 4 (not shown here) by way of a coupling portion 18. The control cam 13 has a control contour 13*a* which runs against the pressure roller 12 (FIG. 4*b*) during the pivotal movement of the control cam 13. The braking or latching device 14 is disposed between the two disks 19*a* and 19*b* of the control cam 13. It is possible to see the rotatable shaft 16, with the first pinion 15*a* mounted thereto. FIG. 5*b* shows an exploded view of the control cam 13. A respective first pinion 15*a* is arranged rotatably on the common shaft 16 at the outside of each of the two disks 19*a* and 19*b*. Arranged non-rotatably on the shaft 16 is a rotor 21 on which the two first clutch portions 17*a* and 17*b* are movably mounted. When the actuating arm 4 exceeds an admissible pivotal speed, the two first clutch portions 17*a* and 17*b* are latched to the tooth arrangement of the second clutch portion 17*c* so that the two first pinions 15*a* are blocked and cannot run any further on the tooth arrangement 17*c* (FIG. 4*b*) whereby the actuating arm 4 is also arrested in its instantaneous pivotal position.

Figure 6A:
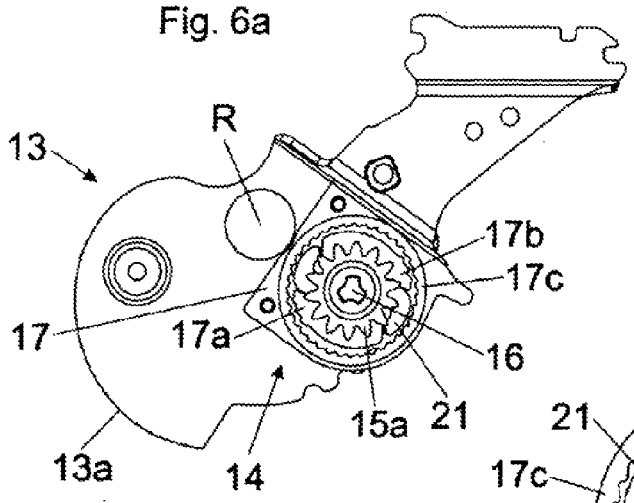
FIGS. 6*a*, 6*b* show a side view of the braking or latching device in the unlatched condition and a detail view on an enlarged scale thereof.

FIG. 6*a* shows a side view of the braking or latching device 14 arranged on the control cam 13, wherein the first clutch portions 17*a* and 17*b* mounted movably to the rotor 21 are not latched to the outer tooth arrangement 17*c*. In that rest position of the two first clutch portions 17*a* and 17*b*, unimpeded movement of the control cam 13 (and therewith the actuating arm 4) about the axis of rotation R is possible so that the braking or latching device 14 does not influence the movement of a furniture flap which properly pivotably connected to the actuating arm 4.

Figure 6B:
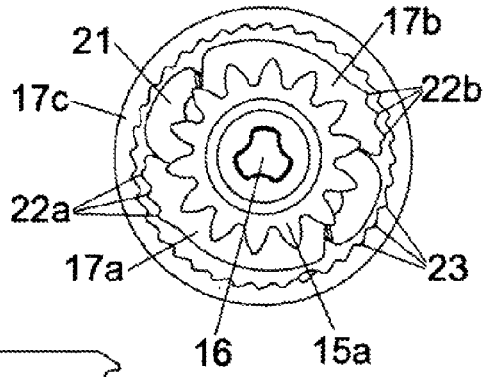

FIG. 6*b* shows the braking or latching device 14 of FIG. 6*a* on an enlarged scale. It is possible to see the rest position of the two first clutch portions 17*a* and 17*b*, the tooth arrangements 22*a* and 22*b* of which are therefore not in engagement with the latching recesses 23 of the outer clutch portion 17*c*. Upon an opening movement of the actuating arm 4 the rotor 21 with the clutch portions 17*a* and 17*b* mounted movably thereto is rotated in the clockwise direction.

Figure 7A:
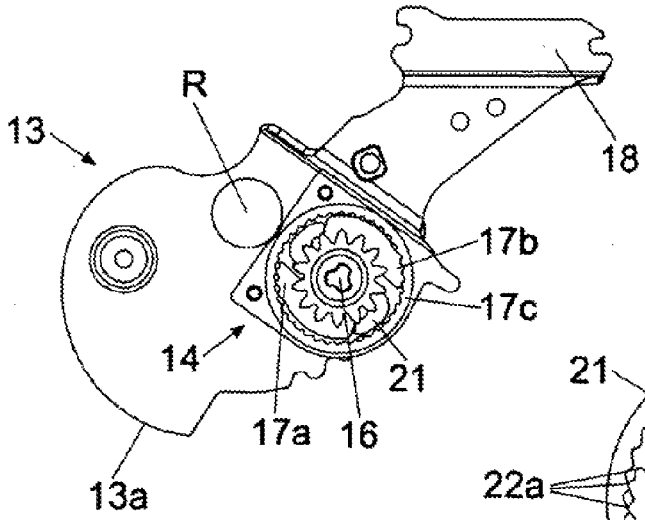
FIGS. 7*a*, 7*b* show a side view of the braking or latching device in the latched condition and a detail view on an enlarged scale thereof.
Figure 7B:
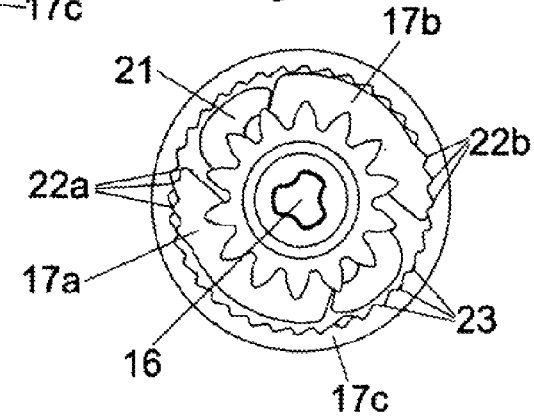

FIG. 7*a* shows in contrast the latched condition of the braking or latching device 14. A further particularity of the invention is to be mentioned in this context. It can be seen from FIG. 7*a* and the enlarged view in FIG. 7*b* that only one of the two first clutch portions 17*a* and 17*b* (namely only the clutch portion 17*b*) is fixedly latched to the outer second clutch portion 17*c*. The latching teeth 22*a* of the first clutch portion 17*a* are displaced relative to the latching teeth 22*b* of the other first clutch portion 17*b* approximately by half a tooth width relative to each other in such a way that upon latching engagement of the latching teeth 22*b* of the clutch portion 17*b* into the latching recesses 23 of the outer clutch portion 17*c* the latching teeth 22*a* of the clutch portion 17*a* just do not latch into the latching recesses 23 of the second clutch portion 17*c*. That situation is particularly clearly visible in FIG. 7*b*. In that way, in the event of the clutch portion 17*b* possibly rebounding, there is still the clutch portion 17*b* which is in a "waiting" position and which, when the actuating arm 4 exceeds the admissible pivotal speed, can latch to the latching recesses 23 of the second clutch portion 17*c*. It will be appreciated, however, that it is also possible that, when the actuating arm 4 exceeds an admissible pivotal speed, both clutch portions 17*a* and 17*b* are simultaneously latchable with the latching recesses 23 of the outer clutch portions 17*c*. The present invention is not limited to the illustrated embodiment but includes or extends to all variants and technical equivalents which can fall within the scope of the claims appended hereto. The positional references adopted in the description such as for example up, down, lateral and so forth are also related to the usual installation position or to the Figure being directly described and illustrated and are to be appropriately transferred to the new position upon a change in position.

The invention claimed is:

1. An actuating device comprising:

a housing;

a pivotally mounted actuating arm for moving a furniture flap;

a spring device for acting on said actuating arm; and an assembly securing device for securing said actuating arm when no furniture flap has been fitted to said actuating arm to thereby prevent accidental opening or deflection of said actuating arm, said assembly securing device including:

a rotatable shaft connected to said actuating arm;

a braking device including a portion connected to said shaft so as to rotate about an axis of said shaft, said braking device being configured to stop a rotation of said shaft and a pivoting movement of said actuating arm when a predetermined pivotal speed of said actuating arm is exceeded;

a step-up transmission including a gear transmission comprising a pinion on said shaft and a tooth arrangement on said housing, said pinion having a different size than said tooth arrangement and being arranged to mesh with said tooth arrangement, said step-up transmission being configured to convert a pivotal speed of said actuating arm at least over a region of a pivot travel of said actuating arm in an opening direction to a greater rotary speed of said shaft based on a predetermined transmission ratio, said braking device being configured to actuate when said greater rotary speed of said shaft exceeds a predetermined rotary speed so as to stop the rotation of said shaft and the pivoting movement of said actuating arm.

2. The actuating device according to claim 1, wherein said transmission ratio of said step-up transmission is greater than 3 such that a speed of rotation of said shaft about said axis of said shaft is greater than 3 times a speed of rotation of said actuating arm about an axis of rotation of said actuating arm.

3. The actuating device according to claim 2, wherein said transmission ratio of said step-up transmission is greater than 5.

4. The actuating device according to claim 1, wherein said step-up transmission comprises an internal gear pair.

5. The actuating device according to claim 1, wherein said pinion is configured and arranged to run along said tooth arrangement during a pivotal movement of said actuating arm.

6. The actuating device according to claim 1, wherein said tooth arrangement is stationary on said housing with respect to said actuating arm, said shaft, and said pinion.

7. The actuating device according to claim 1, wherein an axis of rotation of said pinion is coaxial with an axis of rotation of said braking device.

8. The actuating device according to claim 1, wherein said braking device comprises a centrifugal clutch.

9. The actuating device according to claim 8, wherein said centrifugal clutch has a movably mounted inner first clutch portion and an outer second clutch portion, said first clutch portion being configured to move from an inner rest position to an outer engaged position, said first clutch portion being latched to said second clutch portion at said outer engaged position.

10. The actuating device according to claim 9, wherein said first clutch portion and said second clutch portion are configured to remain uncoupled from each other at or below a predetermined pivotal speed of said actuating arm, and said first clutch portion and said second clutch portion are configured to become coupled when the predetermined pivotal speed of said actuating arm is exceeded.

11. The actuating device according to claim 9, wherein said first clutch portion has a latching tooth for engaging a latching recess of said second clutch portion.

12. The actuating device according to claim 11, wherein said latching tooth is one of a plurality of latching teeth of said first clutch portion, and said latching recess is one of a plurality of latching recesses of said second clutch portion.

13. The actuating device according to claim 9, wherein said first clutch portion comprises a first one of at least two first clutch portions.

14. The actuating device according to claim 13, wherein said first one of said at least two first clutch portions has latching teeth, a second one of said at least two first clutch portions has latching teeth, and said second clutch portion has latching recesses, said latching teeth of said first one of said at least two first clutch portions being displaced relative to said latching teeth of said second one of said at least two first clutch portions through about half a tooth width relative to each other so that, upon latching engagement of said latching teeth of said first one of said at least two first clutch portions into said latching recesses of said second clutch portion, said latching teeth of said second one of said at least two first clutch portions do not latch into said latching recesses of said second clutch portion.

15. The actuating device according to claim 1, wherein said braking device is arranged in or on a portion fixed to said actuating arm so as to be moved with said actuating arm.

16. The actuating device according to claim 15, further comprising a rotatable control cam connected to said actuating arm, said portion being formed or arranged on said rotatable control cam.

17. The actuating device according to claim 1, wherein said pinion comprises a first pinion, said tooth arrangement comprising a second pinion.

18. The actuating device according to claim 1, wherein said tooth arrangement comprises an arc-shaped rack on said housing, said pinion being connected to said actuating arm so as to run along said arc-shaped rack as said actuating arm pivots about an axis of rotation of said actuating arm.

19. An article of furniture comprising:

a furniture body;

a furniture flap; and said actuating device according to claim 1 for moving said furniture flap relative to said furniture body.

* * * * *